US005947177A

United States Patent [19]

Kratzer

[11] Patent Number: 5,947,177

[45] Date of Patent: Sep. 7, 1999

[54] METHOD FOR RETAINING SLATS OF A VERTICAL BLIND

[76] Inventor: Brice Larue Kratzer, 2331 E. Marco Polo Rd., Phoenix, Ariz. 85024

[21] Appl. No.: 09/009,277

[22] Filed: Jan. 20, 1998

[51] Int. Cl.[6] ..... E06B 9/36

[52] U.S. Cl. ..... 160/178.1 V; 160/349.2

[58] Field of Search ..... 160/349.1, 349.2, 160/38, 330, 178.1 V; 24/543

[56] References Cited

U.S. PATENT DOCUMENTS

| | | | |
|---|---|---|---|
| 1,836,018 | 12/1931 | Dover | 160/349.2 |
| 5,343,925 | 9/1994 | Hannerstig | 160/349.2 |
| 5,692,553 | 12/1997 | Jensen | 160/349.2 |
| 5,706,560 | 1/1998 | Anscher et al. . | |

FOREIGN PATENT DOCUMENTS

| | | | |
|---|---|---|---|
| 24979 | 12/1901 | Switzerland | 160/349.2 |
| 4111 | of 1903 | United Kingdom | 160/349.2 |
| 180062 | 5/1922 | United Kingdom | 24/543 |

*Primary Examiner*—Blair M. Johnson
*Attorney, Agent, or Firm*—William E. Hein

[57] ABSTRACT

A sun tie for attachment to a conventional vertical blind, when the blind is drawn to the closed position with the slats rotated to the position in which they are parallel to the plane of the window, to block entry of some heat and light, while permitting a view through the window. The sun tie has an anchor clip or pocket within which a left or right most one of a group of slats of the vertical blind is securedly retained. A group clip of the sun tie removably retains the remaining ones of the group of slats. Each of the sun ties preferably retains 4–7 slats, so that several sun ties may be required to be installed on a particular vertical blind, depending on its width.

1 Claim, 2 Drawing Sheets

METHOD FOR RETAINING SLATS OF A VERTICAL BLIND

BACKGROUND AND SUMMARY OF THE INVENTION

This invention relates generally to vertical blinds of the type that are conventionally installed in residential and commercial buildings and, more specifically, to a decorative device for tying groups of slats of a vertical blind together after the blind has been drawn to the closed position with the slats rotated to the position in which they are parallel to the plane of the window covered by the vertical blind.

Conventional vertical blinds may be drawn to an open position with all of the vertical slats stacked at one side of the blind. They may also be drawn to a closed position in which all of the vertical slats are evenly spaced across the width of the window. When drawn to the closed position, the slats may be rotated in concert to a position in which they are parallel to the plane of the window, thereby completely blocking a view through the window. Alternatively, they may be rotated to a position in which they are perpendicular to the plane of the window, thereby permitting light to enter through the window. In hot climates, it is necessary to draw the blinds to the closed position and then rotate the slats to the position in which they are parallel to the plane of the window in order to block out heat from the sun. However, this position also produces the undesirable result of totally blocking the view through the window.

It would be advantageous to provide a device to be attached to a vertical blind, when it is drawn to the closed position with the slats rotated to the position in which they are parallel to the plane of the window, to block entry of some heat and light, while permitting a view through the window. This and other objects are accomplished in accordance with the illustrated preferred embodiment of the present invention by providing a sun tie having an anchor clip or pocket within which a left or right most one of a group of slats of a vertical blind is securedly retained. A group clip of the sun tie removably retains the remaining ones of the group of slats. Each of the sun ties preferably retains 4–7 slats, so that several sun ties may be required to be installed on a particular vertical blind, depending on its width.

DETAILED DESCRIPTION OF THE PREFERRED EMBODIMENT

Figure 1:
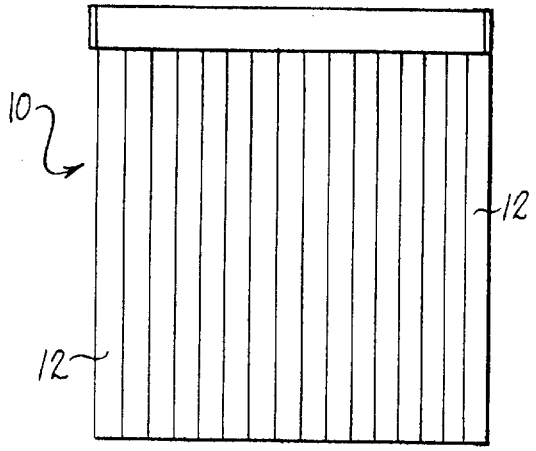
FIG. 1 (PRIOR ART)
FIG. 1 is a pictorial diagram illustrating a conventional vertical blind drawn to the closed position in front of a window, with the slats of the vertical blind rotated to the position in which they are parallel to the plane of the window, thereby totally blocking the entry of light, as well as the view, through the window.

Referring now to FIG. 1, there is shown a conventional vertical blind 10 that has been drawn to the closed position with a plurality of slats 12 rotated to a position in which they are parallel to the plane of a window covered by the vertical blind 10. In this position, the slats 12 of vertical blind 10 serve to minimize the entry of light and heat through the window, but also result in obscuring the view through the window.

Figure 2:
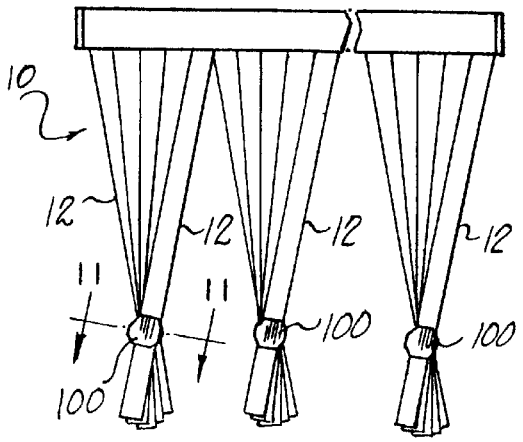
FIG. 2 is a pictorial diagram of the conventional vertical blind of FIG. 1 illustrating the way in which the sun ties of the present invention are installed over groups of five of the slats of the vertical blind to partially block the entry of heat and light while permitting a view through the window.

Referring now to FIG. 2, there is shown the vertical blind 10 of FIG. 1 on which three sun ties 100 of the present invention have been installed to partially block the entry of light and heat through a window, while at the same time permitting a view through the window.

Figure 3:
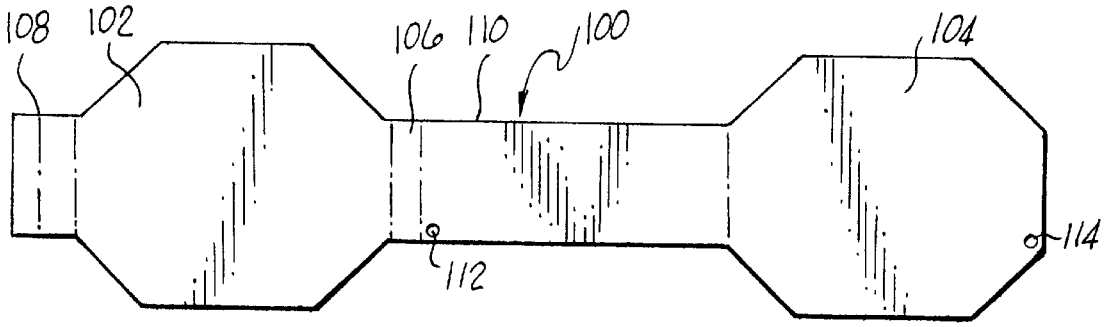
FIG. 3 is a plan view of one of the sun ties of the present invention, illustrating the shape of a die-cut sheet of material from which it may be fabricated by folding.

Referring now to FIG. 3, there is shown the sun tie 100 of the present invention in the flat single-piece shape in which it may be die-cut for subsequent folding and riveting for fabrication. Alternatively, sun tie 100 may be injection molded as a single piece or assembled by screwing or otherwise fastening separate members to form the same finished shape. While the sun tie 100 is preferably fabricated of a PVC plastic material like that from which the blind slats themselves are fabricated, other plastic materials, as well as other materials such as metal, may be chosen.

Figure 4:
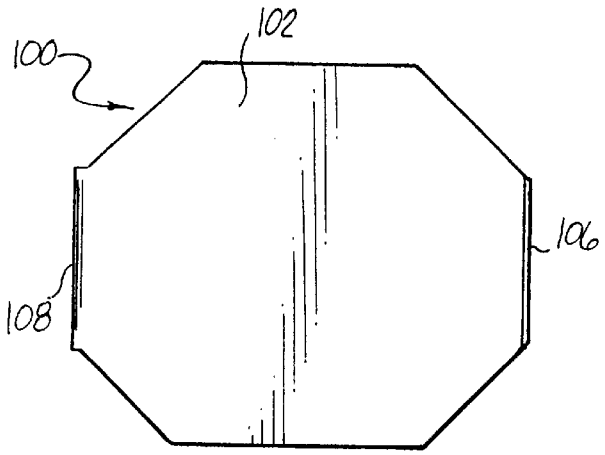
FIG. 4 is a front view of an assembled one of the sun ties of the present invention.
Figure 5:
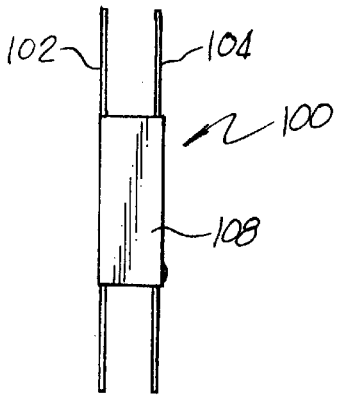
FIG. 5 is a side view of the assemble sun tie. of FIG. 4.
Figure 6:
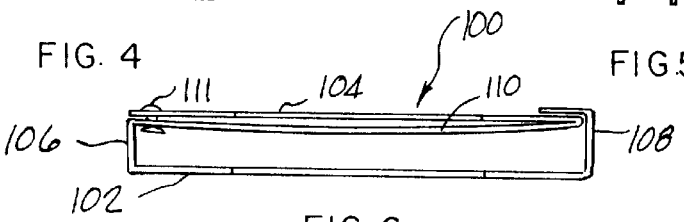
FIG. 6 is a top view of the assembled sun tie of FIGS. 4 and 5.

Referring now additionally to FIGS. 4–6, there are shown front, side, and top views, respectively, of sun tie 100 in its assembled form. Sun tie 100 comprises an octagonally-shaped front face 102, a correspondingly-shaped rear face 104, a side hinge member 106, a clasp member 108, and an anchor member 110. While the front and rear faces 102, 104 have been shown to be octagonal in shape, any other desired geometric shape may be chosen. When the flat die-cut piece of material illustrated in FIG. 3 is folded to the final form illustrated in FIGS. 4–6, a rivet 111 or other conventional fastener is inserted through holes 112, 114 in anchor member 110 and rear face 104, respectively. When attached by rivet 111, rear face 104 and anchor member 110 form an anchor clip or pocket through which a single slat 12 of the vertical blind 10 is inserted for retention. The space between anchor member 110 and front face 102 of sun tie 100 comprises a group clip for retaining the remaining ones of a group of slats 12 of vertical blind 10 to be held by sun tie 100. Access to the group clip for the purpose of securing or releasing the ones of slats 12 to be retained thereby is by way of the clasp member 108. Clasp member 108 may simply be bent away from the fold between rear face 104 and anchor member 110 to open the group clip by allowing front face 102 to be moved about hinge member 106 away from anchor member 110. Similarly, the group clip may be closed by returning front face 102 and clasp member 108 to their positions illustrated in FIG. 6.

Figure 7:
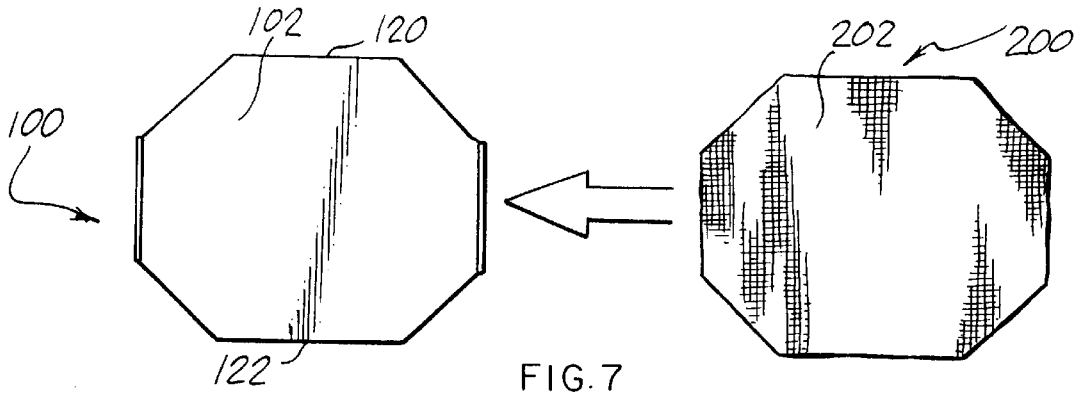
FIG. 7 is a diagram illustrating the way in which a decorative panel may be slid over the front face of the sun tie of FIGS. 4–6.

One or both of the front and rear faces 102, 104 may be decorated by painting or by providing a decorative panel 200, as illustrated in FIG. 7, that may be slid over front face

Figure 8:
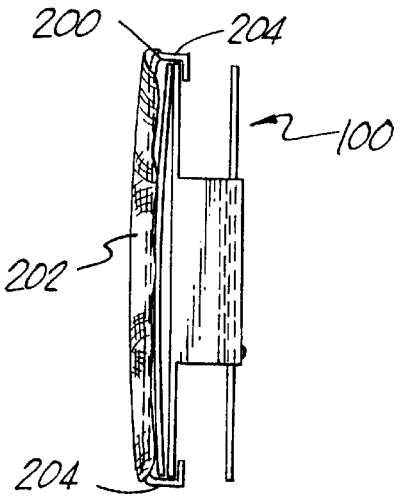
FIG. 8 is a side view of the sun tie of FIGS. 4–7 with the decorative panel of FIG. 7 positioned over the front face thereof.

102 of sun tie 100, as illustrated in FIG. 8. If desired, the rear face 104 of sun tie 100 may also be covered by a second decorative panel 200. Decorative panel 200 may be fabricated of the same material as sun tie 100 and may be covered with a decorative fabric or other decorative material 202. Decorative panel 200 is held in place over front face 102 or rear face 104 by way of flanges 204 that simply slide over top and bottom edges 120, 122 of front face 102, for example.

Figure 9:
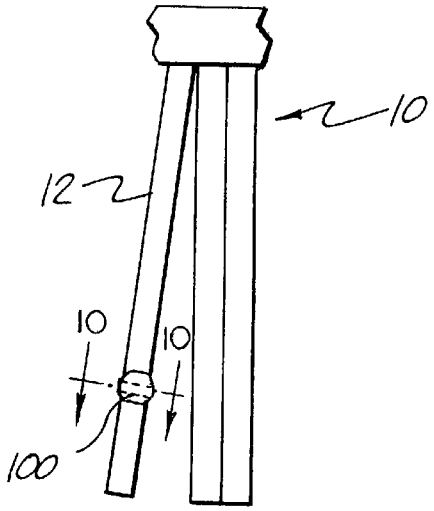
FIG. 9 is a diagram illustrating the way in which the sun tie of FIGS. 4–6 is installed by sliding it over the left one of a group of slats of the vertical blind of FIGS. 1 and 2.
Figure 10:
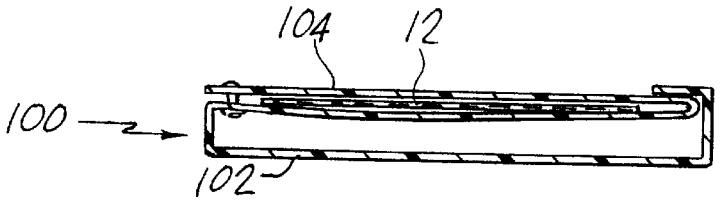
FIG. 10 is a sectional view through the line 10—10 of FIG. 9.
Figure 11:
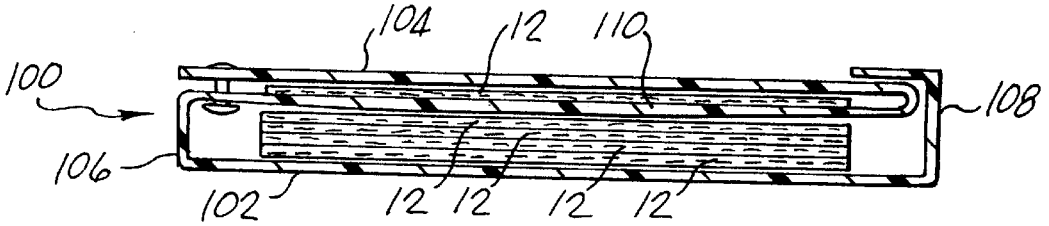
FIG. 11 is a sectional view through the line 11—11 of FIG. 2.

In use, the vertical blind 10 is drawn to the closed position, and the slats 12 are rotated to the position in which they are parallel to the plane of the window covered by vertical blind 10, as illustrated in FIG. 1. Sun tie 100 is then simply slipped over the bottom end of a left or right most one of a group of slats 12 of vertical blind 10 that are desired to be retained by sun tie 100, such that the single slat 12 resides within the anchor clip or pocket that is formed between rear face 104 and anchor member 110, as illustrated in FIGS. 9 and 10. The width of the anchor clip or pocket so formed must be sufficient to accommodate the single slat 12 without bending it, but not so wide as to allow sun tie 100 to freely slip downward on the single slat 12. While sun tie 100 is preferably installed approximately 12 inches from the bottom of the single slat 12, any other distance may be selected. The remaining 4–6 slats of the group of slats 12 chosen to be retained within a particular one of sun ties 100 are then positioned within the group clip of sun ties 100, and the clasp 108 is latched to close the group clip, as illustrated in FIGS. 2 and 11. At such later time as it is desired to return the vertical blind 10 from the configuration of FIG. 2 to that of FIG. 1, the clasp 108 of each of the installed sun ties 100 is released, thereby releasing each one of the group of slats 12 previously retained within the group clip. The single one of slats 12 retained within the anchor clip of each of the sun ties 100 remains so retained to facilitate returning the vertical blind 10 the next morning to the configuration illustrated in FIG. 2.

I claim:

1. A method for retaining a selected plurality of vertical slats of a vertical blind, mounted in front of a window, when the vertical blind has been drawn to a closed position with the slats thereof rotated to a position in which they are parallel to the plane of the window, the method comprising:

providing a sun tie having an anchor pocket for retaining an outer one of said selected group of vertical slats, said sun tie having a group clip positioned in front of said anchor pocket for releasably retaining ones of said selected group of vertical slats;

inserting a bottom edge of said outer one of said selected group of slats into said anchor pocket of said sun tie;

moving said sun tie upward on said outer one of said selected group of vertical blinds a desired distance from said bottom edge;

gathering remaining ones of said selected group of vertical slats in overlying relationship to each other; and securing the gathered remaining ones of said selected group of vertical slats in said overlying relationship to each other within said group clip of said sun tie.

* * * * *